United States Patent [19]

Frey et al.

[11] 4,090,757

[45] May 23, 1978

[54] RECESSED PULL FOR DRAWERS OR THE LIKE

[75] Inventors: Frederick J. Frey; Daniel S. Kaminski, both of Michigan City, Ind.

[73] Assignee: InterRoyal Corporation, New York, N.Y.

[21] Appl. No.: 679,966

[22] Filed: Apr. 26, 1976

[51] Int. Cl.[2] ..... A47B 95/02

[52] U.S. Cl. ..... 312/320; 312/330 R; 16/124

[58] Field of Search ..... 312/320, 330, 234.4, 312/234.3, 234.5; 16/124

[56] References Cited

U.S. PATENT DOCUMENTS

| | | | |
|---|---|---|---|
| 1,304,700 | 5/1919 | Otte | 16/124 |
| 2,335,391 | 11/1943 | Cushing | 312/320 |
| 2,793,386 | 5/1957 | Muhlhauser | 16/124 |
| 3,098,686 | 7/1963 | Benoit | 312/320 |
| 3,117,339 | 1/1964 | Vigna | 312/320 |
| 3,206,270 | 9/1965 | Vincens | 312/320 |
| 3,412,421 | 11/1968 | Gerber | 312/320 |
| 3,603,659 | 9/1971 | Richardson et al. | 312/330 |
| 3,646,634 | 3/1972 | Fusselman | 312/320 |
| 3,932,010 | 1/1976 | Kenworthy | 312/320 |
| 3,969,009 | 7/1976 | Radek | 16/124 |

*Primary Examiner*—Paul R. Gilliam
*Assistant Examiner*—Victor N. Sakran
*Attorney, Agent, or Firm*—Arthur A. March

[57] ABSTRACT

A recessed pull for drawers or the like which have inner and outer front panels disposed at the forward end thereof including an aperture in the outer front panel and a trim piece covering said aperture, said trim piece being provided with grooves or slots along the upper and lower edges in which the edges of the aperture are accommodated and a cover member having rear, top, bottom and side walls, is secured to the front surface of the inner front panel by welding directly to the rear of the aperture formed in the outer front panel to provide the recessed pull.

4 Claims, 4 Drawing Figures

RECESSED PULL FOR DRAWERS OR THE LIKE

BACKGROUND OF THE INVENTION

Standard drawer pulls for desks consisting of bars extending outwardly from the front portion of the drawer have become increasingly undesirable. The protrusion of the pull itself has caused damage to the clothing of persons passing in front of the desk in close proximity thereto and at times has been somewhat abrasive physically. As a consequence, there has been an increasing tendency to provide recessed pulls for desk drawers in which the front panel of the drawer itself is provided with an aperture through which the hand may extend to grip the inner surface of the panel around the aperture to pull the drawer outwardly. The structures proposed have necessitated the use of trim pieces to surround the raw edges of the aperture and of box-like elements rearwardly of the aperture for the concealment of the inner portion of the drawer which might otherwise be exposed through the aperture. The proposals involve structures of some relative expense and have attendant difficulties in the assemblage of the various parts including the requirement for inter-sliding engagemant between a trim piece and a box-like rear element which necessitated the maintenance of relatively close tolerances between the respective parts.

Other proposed solutions provide recessed pulls which would inadvertently come apart under certain conditions of abuse and which did not maintain the interlocking arrangement over long periods of time.

SUMMARY OF THE PRESENT INVENTION

The present invention provides a recessed drawer pull which is extremely simple to assemble and which eliminates the necessity for any inter-sliding engagement and thus any maintenance of relatively close tolerance. With the present invention, there is utilization of currently existing drawer structures for maintaining portions of the recessed pull in position for functioning to assist in opening the drawer.

It is known that present metal drawer structures comprise inner and outer front panels at the front of the drawer. A small pocket is thereby formed between the two panels at the front portion of each sliding drawer in conventional present-day desks. The present invention provides a simple recessed pull using both of these panels and the pocket therebetween. In accomplishing this result, an aperture is provided in the front panel which, in accordance with present day practice, is preferably rectangular. This aperture exposes the front face of the inner front panel which is secured to the outer front panel. A cover element in the form of a casing having top, bottom, rear and side walls and an open front is welded or otherwise adhered to the front face of the inner front panel immediately in back of the aperture.

A trim piece having a groove or slot in at least its upper and lower surfaces is disposed in the aperture with the upper and lower edges of the panel around the aperture fitting into the aforesaid slots or grooves to lock the trim piece in position. The rear face of the trim piece may be provided with a beveled portion along its upper or lower edges so that it can flex when pressure is exerted forcing it into the aperture and then resume its normal size and shape when the edges of the trim piece are located adjacent to the aforesaid grooves or slots. The front face of the trim piece surrounds the edges of the aperture to present an attractive and neat appearance.

The trim piece is described in detail in my co-pending application Ser. No. 679,965, filed Apr. 26, 1976.

As a result of the aforesaid construction, the cover member may be utilized as a cavity into whose edges the user's hand may be inserted for pulling the drawer outwardly or pushing it inwardly. Because of the cover member and the adjacent trim piece, the pocket between the front and rear panels at the forward end of the drawer is concealed and the trim piece and cover member appear as a unitary structure when viewed by the user.

The cover member can be economically secured to and carried by the front of the rear panel without necessitating any inter-locking arrangement whatsoever between it and the front piece, although their arrangement is such that they may outwardly appear to be cooperatively engaging.

While in the drawings and following description a preferred embodiment of the invention is described and illustrated, it is to be understood that this is only to facilitate an understanding thereof and not at all to be interpreted as any limitation upon the scope of the invention.

DETAILED DESCRIPTION OF THE DRAWINGS

Figure 1:
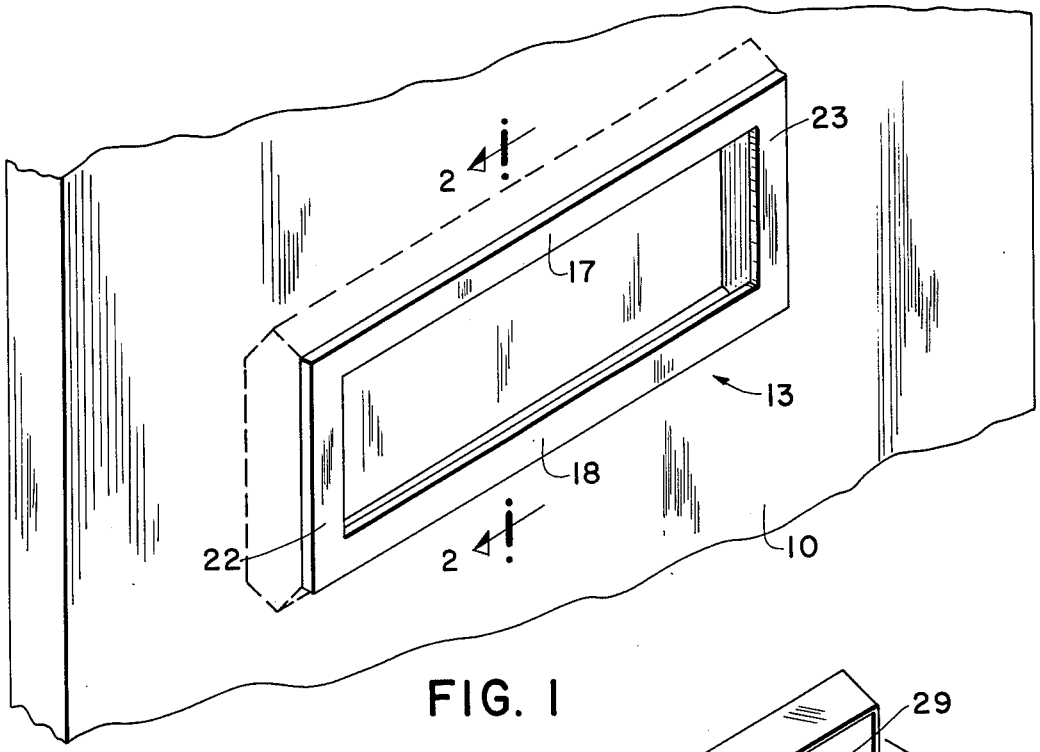
FIG. 1 is a perspective view of the front panel of a desk drawer or the like with the recessed pull of the present invention in position and showing, in dotted lines, the element of the recessed pull disposed to the rear of the front panel.

As shown, there is a desk drawer or the like comprising an outer front panel 10 and an inner front panel 11 which may be joined together by any suitable means to form the front vertical wall of the drawer. In the usual metal drawer, this inner and outer front panel arrangement is a standard construction. Heretofore a variety of pulls have been utilized in drawers including the usual bar-like semi-loop which is grasped by the hand and is pulled or in recessed pulls those where there are inter-slideably engagements utilized between the various pieces.

The present invention eliminates the problems and drawbacks of present drawer pulls which are somewhat difficult and expensive to assemble and prevents possibilities of injury or damage to clothing that can be caused by protruding pulls. In so doing, the present invention utilizes the construction of standard drawers. However, an aperture 12 in the outer front panel 10 is provided. A trim piece 13 is provided and has a groove or slot 14 between its upper and lower inner faces 15 and 16 and the respective outer faces 17 and 18. As shown, the trim piece is provided with beveled edges 19 and 20 in the rear upper or lower face 15 and 16. This construction is more fully described in my corresponding application Ser. No. 679,965, filed Apr. 26, 1976.

With the foregoing construction, it is only necessary to press the trim piece into the aperture whereby the face provided with the beveled edge will flex and deform to permit the passage of the rear wall into the aperture and past the edges 21 surrounding the aperture. When the trim piece has been so inserted and the rear faces pass the edges 21 of the aperture, the trim piece will slightly expand, returning to its normal position with the edges 21 around the aperture being located in the groove 14 in the trim piece intermediate the front and rear surfaces of the trim piece. The front surface of the trim piece including the upper and lower faces as well as the side faces 22 and 23 surround the aperture and conceal the edges to provide an attractive surrounding for the aperture 12.

Figure 2:
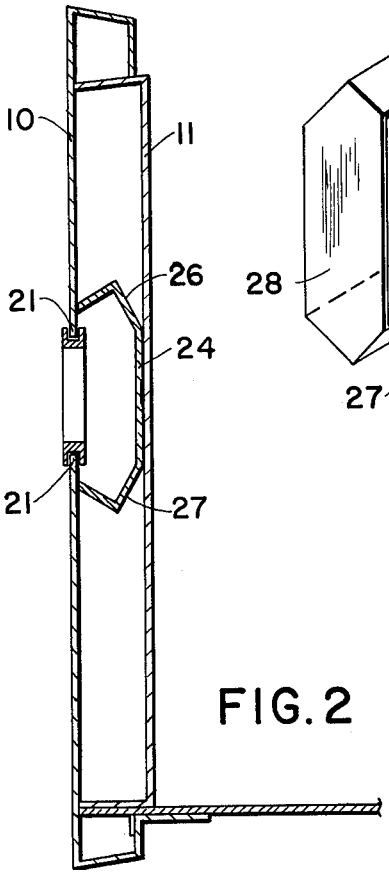
FIG. 2 is a section taken along the lines 2—2 of FIG. 1.
Figure 3:
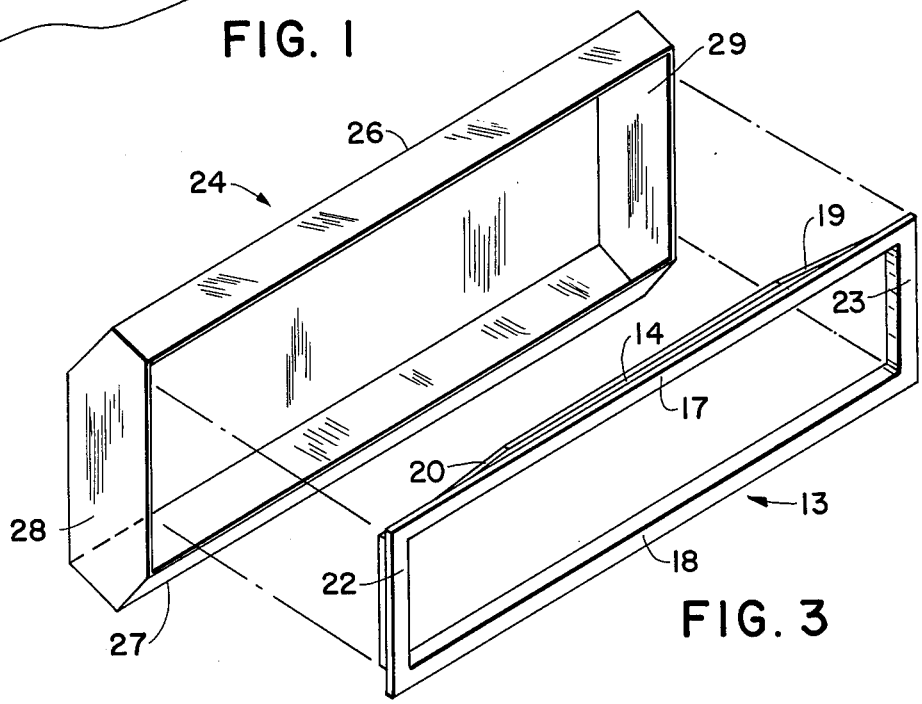
FIG. 3 is an exploded perspective view separately showing the cover member and trim piece.
Figure 4:
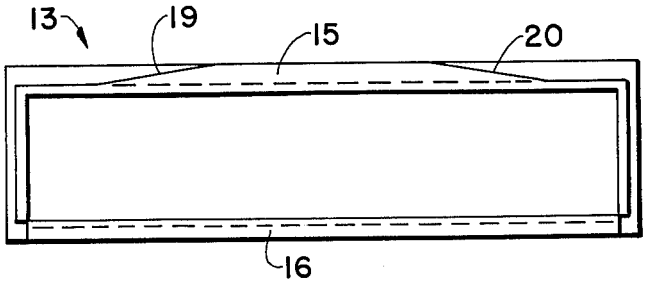
FIG. 4 is a rear view of the trim piece.

A cover member 24 is disposed to the rear of the aperture. The cover member preferably comprises a rear wall 25, a top wall 26, a bottom wall 27, and side walls 28 and 29. As shown, the top wall 26 and bottom wall 27 are provided with a concave pitch to enhance the appearance thereof when viewed through the aperture 121 yet the cover member walls are vertically remote from the margins of such aperture (see FIG. 2). The cover member 24 completely conceals the pocket 30 formed between the outer front panel 10 and inner front panel 11 and provides a neat, tidy and attractive arrangement together with the front panel. In accordance with the present invention, there are no tolerances whatsoever necessary to be maintained between the trim member 13 and the cover member 24 as there need be no inter-engagement between these elements if it is not desired. This is accomplished by utilizing the existent panel members in the usual drawers. As illustrated, the rear wall 25 of the cover member 24 is welded at 31 to the front of the inner front panel 11. The weld is accomplished to present an attractive and unbroken line in the viewable portion of the cover member although, of course, other suitable means for securing the cover member to the inner front panel may be utilized.

The invention contemplates the use of existing drawer panel structure and it is possible within the scope of the invention to secure the front edges of the top, bottom and/or side walls of the cover member 24 to the rear of the outer front panel by welding or the like, if desired.

As a consequence, a simple, easy to assemble recessed pull is provided which has all the neatness and attractiveness of an inter-engaging trim piece and cover member without requiring the difficulties normally inherent in such an assemblage nor the maintenance of tolerances which have heretofore been required.

The recessed pull and trim piece are preferably metal and the recessed pull elements including the trim piece are all preferably metal and, in accordance with current-day styling, rectangular in shape. However, it will be understood that any suitable type of material may be utilized and substantially any shape produced by the various components within the purview of the invention.

The foregoing description sets forth the embodiment of the present invention, but it is to be understood that the specifics are merely to facilitate an understanding of the invention and are not intended in any way to limit the scope thereof as defined in the appended claims.

We claim:

1. A drawer or the like comprising:

a spaced apart inner front panel and outer front panel together forming the front vertical wall of the drawer, said outer front panel having an aperture intermediate its edges; a trim piece surrounding said aperture; and a cover member fixedly secured to the front surface of said inner front panel and disposed in the space between said inner front panel and said outer front panel rearwardly of the aperture in said outer front panel and vertically remote from the margins of such aperture to form a recessed pull for said drawer.

2. The drawer of claim 1 in which the cover member and trim member are of metal.

3. The drawer of claim 1 in which said cover member is provided with rear, top, bottom and side walls.

4. The drawer of claim 3 in which the top and bottom walls of the cover member are concave.

* * * * *